US006168369B1

(12) United States Patent
Bright et al.

(10) Patent No.: US 6,168,369 B1
(45) Date of Patent: Jan. 2, 2001

(54) CARRIER RETAINER SYSTEM

(75) Inventors: Christopher Erik Bright, Wilson; Michael R. Gibbons, Smithfield, both of NC (US)

(73) Assignee: Caterpillar Inc., Peoria, IL (US)

( * ) Notice: Under 35 U.S.C. 154(b), the term of this patent shall be extended for 0 days.

(21) Appl. No.: 09/182,713

(22) Filed: Oct. 29, 1998

(51) Int. Cl.[7] ..... E02F 9/00

(52) U.S. Cl. ..... 414/724; 414/912; 414/723; 37/468; 37/903; 37/405

(58) Field of Search ..... 414/723, 724, 414/912; 37/403, 468, 405, 903

(56) References Cited

U.S. PATENT DOCUMENTS

| | | | |
|---|---|---|---|
| 3,115,261 | 12/1963 | Antolini . | |
| 3,214,041 | 10/1965 | Walberg . | |
| 3,312,361 | 4/1967 | Foster . | |
| 3,421,642 | 1/1969 | Carter . | |
| 4,247,243 | 1/1981 | Carter . | |
| 4,422,819 | 12/1983 | Guest . | |
| 4,669,947 | 6/1987 | Frost . | |
| 4,790,084 | 12/1988 | Anderson et al. . | |
| 5,064,338 * | 11/1991 | Lawrence | 414/723 X |
| 5,779,429 * | 7/1998 | Poole | 414/723 |

FOREIGN PATENT DOCUMENTS 2301577 12/1996 (GB) .

* cited by examiner

*Primary Examiner*—Donald W. Underwood
(74) *Attorney, Agent, or Firm*—August E. Roehrig, Jr.

(57) ABSTRACT

When operating a work vehicle such as a backhoe or wheel loader, it is frequently desirable to utilize auxiliary work equipment with the vehicle such as a pallet fork and a loading bucket. In the course of such operation, it is generally necessary to move the vehicle from one site to another, which requires movement of the auxiliary work equipment as well as the vehicle. The present invention provides a convenient coupling system for securely attaching a second work implement, such as a loading bucket, to a first work implement, such as pallet forks, for transportation purposes so that the connected auxiliary work equipment can be readily transported by the work vehicle from site to site, which is especially important when moving the vehicle over uneven and rough ground or surfaces.

10 Claims, 7 Drawing Sheets

CARRIER RETAINER SYSTEM

TECHNICAL FIELD

This invention relates generally to a retainer coupling system for use with work implements such as used on a backhoe, wheel loader or other such work vehicle and, more particularly, to a retainer or secondary coupling system for use in coupling a second work implement to a first work implement which has been coupled to a work vehicle by a primary coupling formed in part on the work vehicle, to enable both work implements to be conveniently and securely connected to each other to facilitate the simultaneous carrying of both of the work implements by the work vehicle, especially over rough and uneven terrain.

BACKGROUND ART

When operating a work vehicle such as a backhoe or wheel loader, it is frequently desirable to utilize auxiliary work implements or equipment with the vehicle, such as a pallet fork and a loading bucket. In the course of such operation, it is generally necessary to move the vehicle from one site to another, which requires movement of the auxiliary equipment as well as the vehicle. The present invention provides a convenient secondary retainer system for securely attaching a second work implement, such as a loading bucket, to a first work implement, such as pallet forks, which are coupled to the work vehicle by means of a primary coupling formed in part on the work vehicle, so that the two connected work implements can be readily transported by the work vehicle from site to site. This is especially beneficial when the work vehicle must move over rough surfaces or uneven terrain.

Various attempts have been made to couple work implements together, such as the pallet forks of work vehicles with a loading bucket, because of the frequency with which both of such auxiliary work equipment is used. Such attempts are illustrated in the following U.S. patents: H. S. Antolini, U.S. Pat. No. 3,115,261; M. E. Walberg, U.S. Pat. No. 3.214,041; W. E. Foster, U.S. Pat. No. 3,312,361; J. D. Carter, U.S. Pat. No. 3,421,642; J. D. Carter, U.S. Pat. No. 4,247,243; W. H. Guest, U.S. Pat. No. 4,422,819 and R. A. Frost, U.S. Pat. No. 4,669,947.

In each of these patents various structures are disclosed which combine the pallet forks of a work vehicle with a loading bucket which enables the two work implements to be transported together by the work machine. However, such structures also require that during use of one or both of the work implements, the other work implement must be carried by the work vehicle. Such structural limitations reduce the load lifting capacity of the work vehicle, and decrease working efficiency. The inclusion of a second unnecessary piece of auxiliary work equipment on the work vehicle when the work vehicle is working with a different piece of auxiliary equipment, reduces the payload of the work vehicle which would otherwise be increased if the two pieces of auxiliary equipment could be transported together, but employed separately when in use.

R. L. Anderson et al, U.S. Pat. No. 4,790,084 discloses a structure for use with a backhoe wherein a backhoe bucket can be carried in a loader bucket attached to the backhoe by means of a hook connected to the loader bucket which engages the backhoe bucket for nesting inside the loader bucket during transportation. In this manner, a second bucket can be transported with the backhoe, but the second bucket is not carried by the backhoe during work operations, that is, when the loader bucket is being utilized. This structure, however, is limited in use to nested loader buckets, and the larger or loader bucket is attached directly to the backhoe, rather than through a primary coupling.

The present invention is directed to overcome one or more of the problems as set forth above.

DISCLOSURE OF THE INVENTION

In the preferred embodiments of this invention a primary coupling, a work implement to work vehicle retainer coupling, is carried in part on a first work implement, such as a pallet fork attachment, and in part on the work vehicle to permit the interchangeable attachment of various work implements to the work vehicle. A secondary work implement to work implement retainer coupling is carried on each one of the vertically extending forks carriage plates of the pallet fork attachment through which the pallet fork attachment is coupled to the front end of a work vehicle, such as a backhoe or a wheel loader. The secondary retainer couplings are securely connected to the pallet fork attachment, and are positioned to be secured to a second work implement to form a rigid connection between the pallet fork attachment and the second work implement, such as a loading bucket. In this manner, the second work implement can be readily and securely transported on the fork tines of the pallet fork attachment, and readily detached after transportation, so that only one of the work implements is carried by the work vehicle when working with either one of the implements.

In the first embodiment of the retainer coupling, a "C" or "U"-shaped bracket is welded to each one of the vertical forks carriage plates adjacent to the outside leading edge thereof. An "L"-shaped plate, having a securing aperture formed in the distal end thereof, is slidably carried within each of these brackets for movement toward and away from the outside leading edge of the vertically extending forks carriage plates. The "L"-shaped plate is slidable from a first or retracted position wherein the distal end thereof is adjacent to the outside leading edge of the forks carriage plates, to a second or extended position wherein the distal end thereof extends outwardly beyond the outside leading edge of the forks carriage plates a distance sufficient so that the apertures formed therein may be concentrically aligned with the connecting pin holes of the loading bucket carriage plates, when the loading bucket is positioned onto the fork ties of the pallet forks attachment. Locking pins are then inserted through the concentrically aligned holes formed in the "L"-shaped bracket and the connecting pin holes of the loading bucket, thereby rigidly securing the loading bucket to the pallet forks attachment for transportation therewith.

In the second embodiment of the retainer coupling, a pivotal link is secured to the outside of each one of the forks carriage plates, and may be pivoted from a first or storage position in which the links are secured to the forks carriage plates, to a second or extended position wherein the links may be secured to the connecting pin holes of the loading bucket. To this end, the distal end of each link is formed with an aperture for coaxial alignment with the connecting pin holes of the loading bucket. To enable the links to be moved toward or away from a loading bucket carried on the fork tines of the pallet forks attachment, the proximal end of each link, which is pivotally connected to the forks carriage plate, is formed with a slot to enable the link to be moved toward or away from the pivotal connection. In this manner, the aperture in the distal end of the pivotal link can be more readily concentrically aligned with the connecting pin holes of various loading buckets to rigidly connect the two work implements together for transporting the implements, but each implement can be separately utilized without the presence of the other during working operations.

BRIEF DESCRIPTION OF THE DRAWINGS

In the accompanying drawings like reference numerals indicate corresponding parts throughout.

BEST MODE FOR CARRYING OUT THE INVENTION

Figure 1:
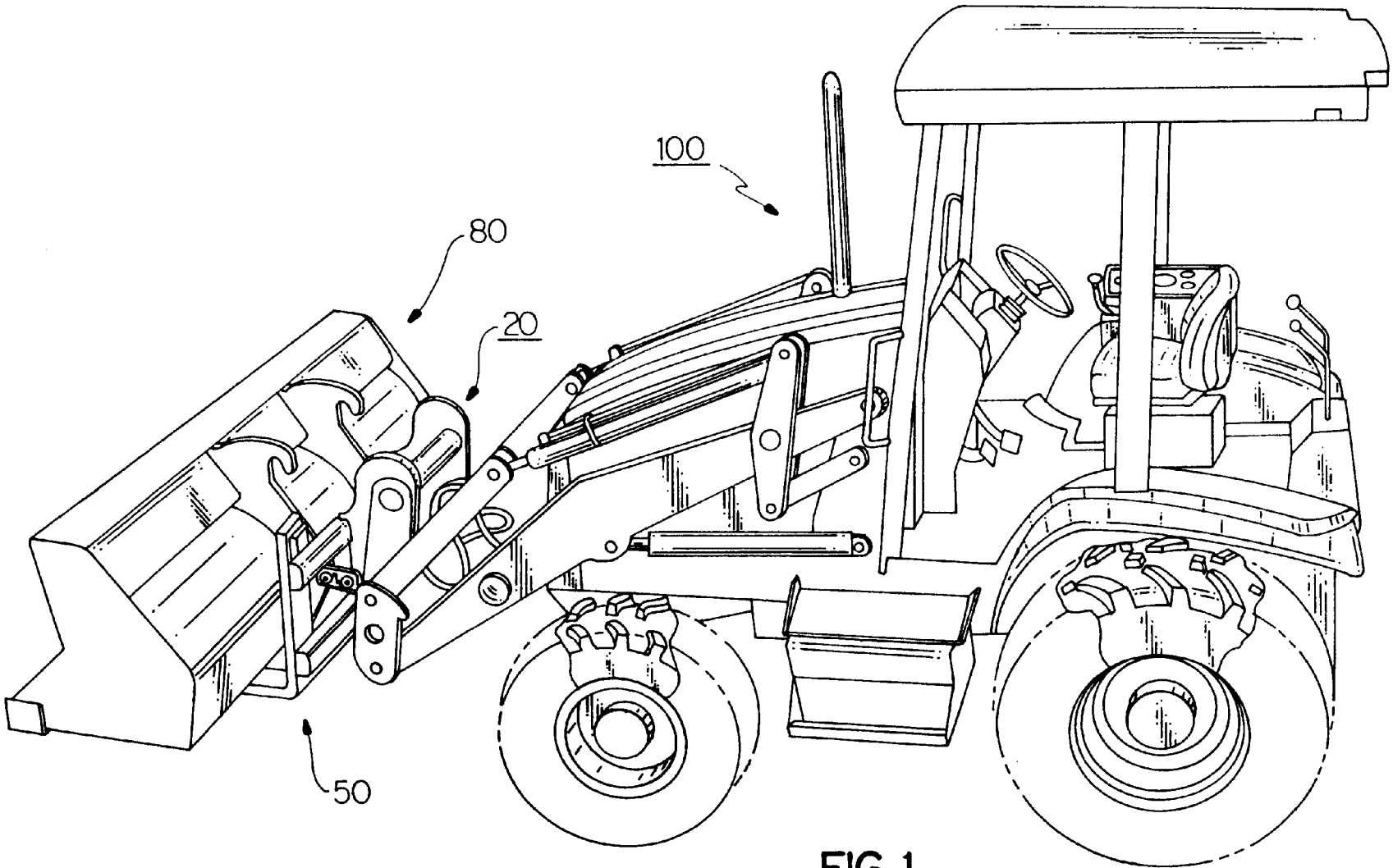
FIG. 1 is a front perspective view of a work machine having a pallet fork attachment embodying the invention connected to the work machine and carrying a loading bucket connected thereto.
Figure 2:
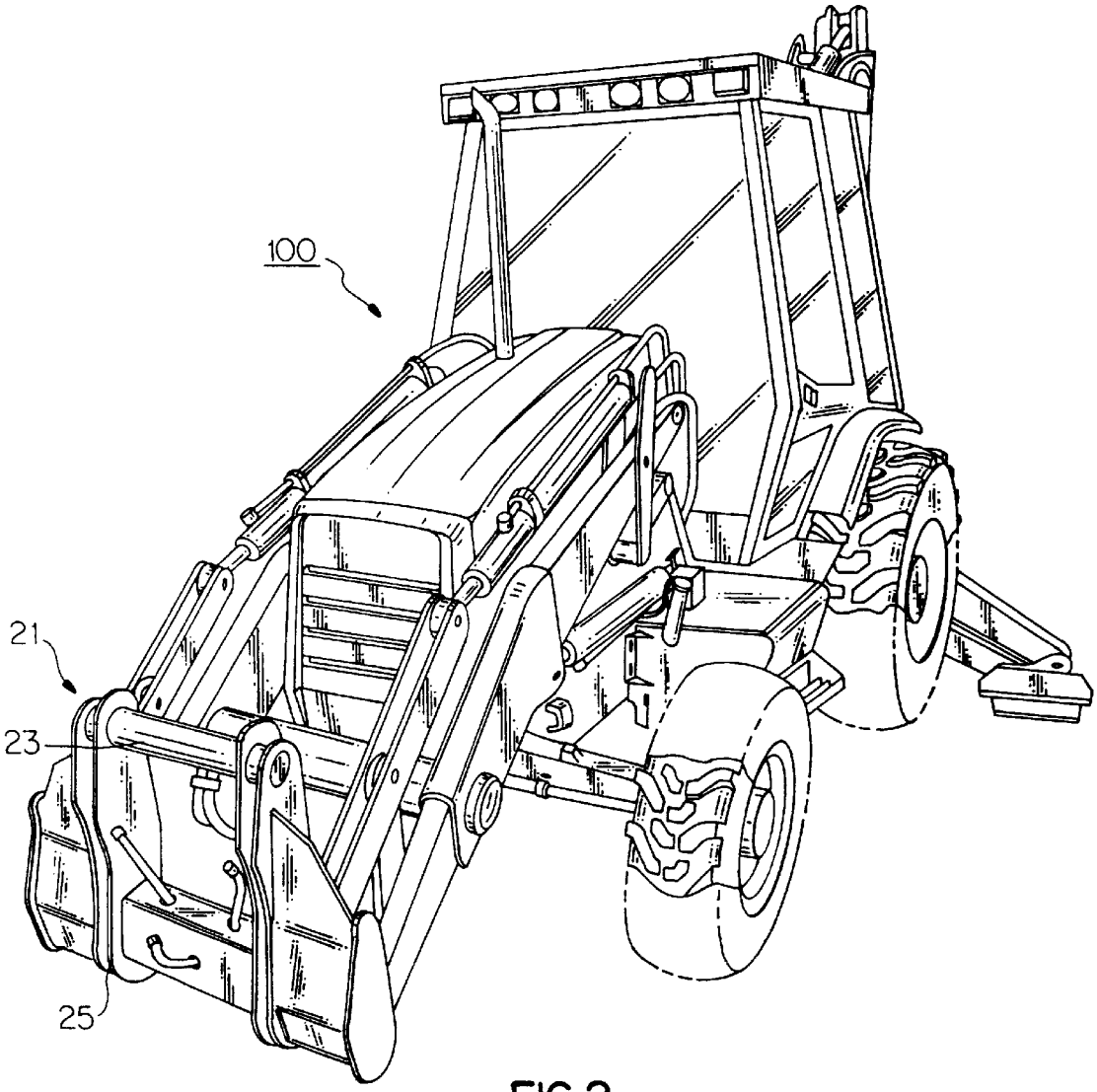
FIG. 2 is a front perspective view of a work machine illustrating the portion of the primary coupling carried by the work machine to permit the interchangeable coupling of various work implements onto the machine.

Referring now to the drawings, there is illustrated in FIGS. 1 and 2 a work vehicle such as a backhoe 100 having a first work implement such as a pallet fork attachment 50 attached thereto by a primary coupling 20 which permits various work implements to be interchangeably attached to the work vehicle. A portion 21 of the primary coupling 20 is carried by the work vehicle 100 and includes a support bar 23 and connectors 25 for coupling to a work implement. Another portion 22 of the primary coupling is carried on each of the interchangeable work implements that may be attached to the primary coupling 20 through carriage plates 51 or 81 and connecting pin holes 85. While a particular structure for such a primary coupling 20 is illustrated in the drawings, it is to be understood that the invention is not to be limited to the particular primary coupling construction disclosed as the preferred embodiment, and the best mode presently known for practicing the invention, but it is intended that the invention include any primary coupling construction whereby various work implements can be interchangeably connected to a work vehicle.

As best illustrated in FIGS. 3–8, the pallet fork attachment 50 carries a second work implement, such as a loader bucket 80, which is secured to the pallet fork attachment 50 by means of one of the embodiments of a secondary retainer coupling for transporting the loading bucket 80 with the pallet fork attachment 50 when the work machine moves between work sites.

Figure 3:
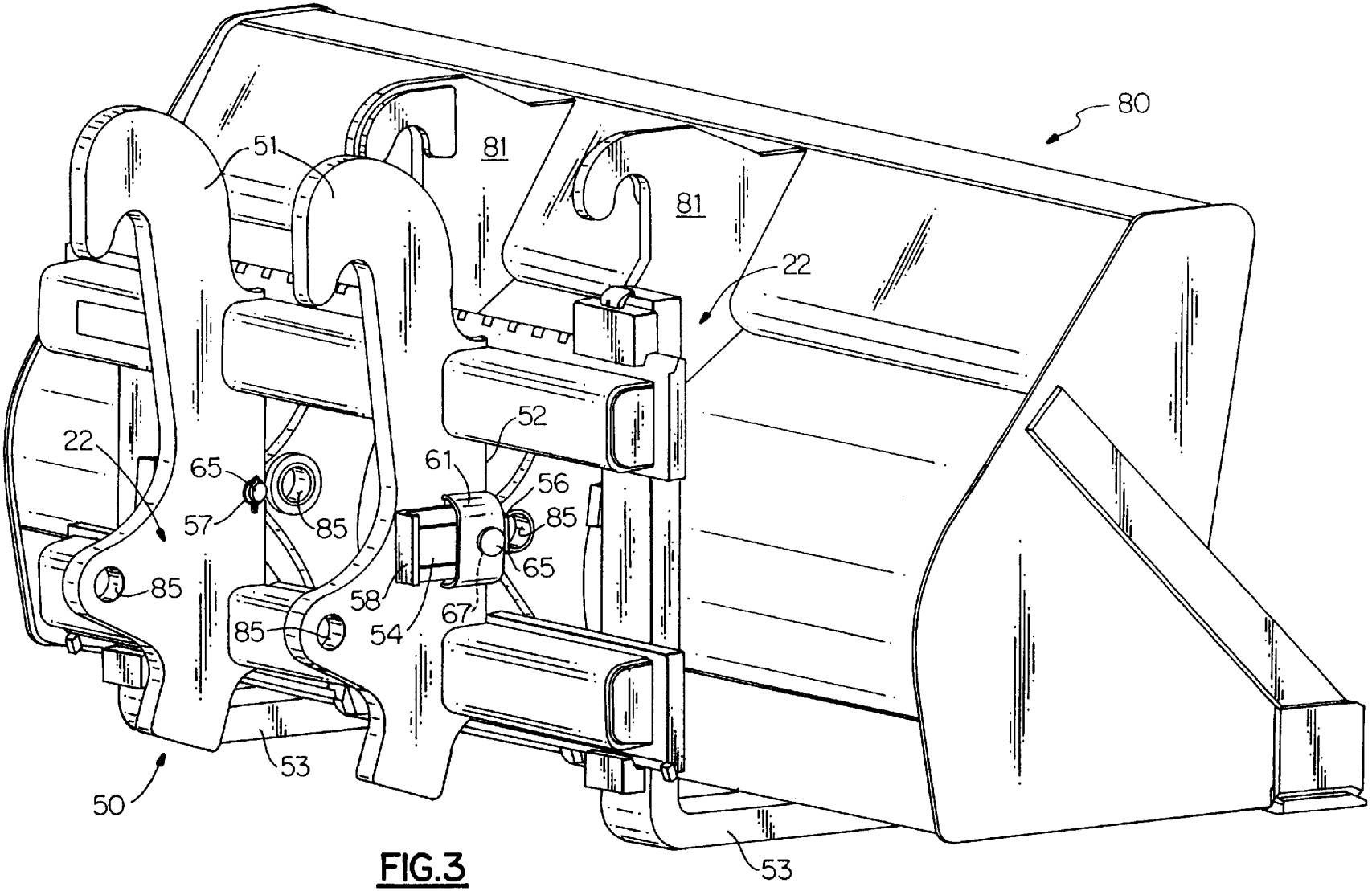
FIG. 3 is a rear perspective view of a pallet fork attachment for a work machine embodying a first embodiment of a retainer coupling with a loading bucket positioned thereon to be connected to the pallet fork attachment for transportation purposes.
Figure 4:
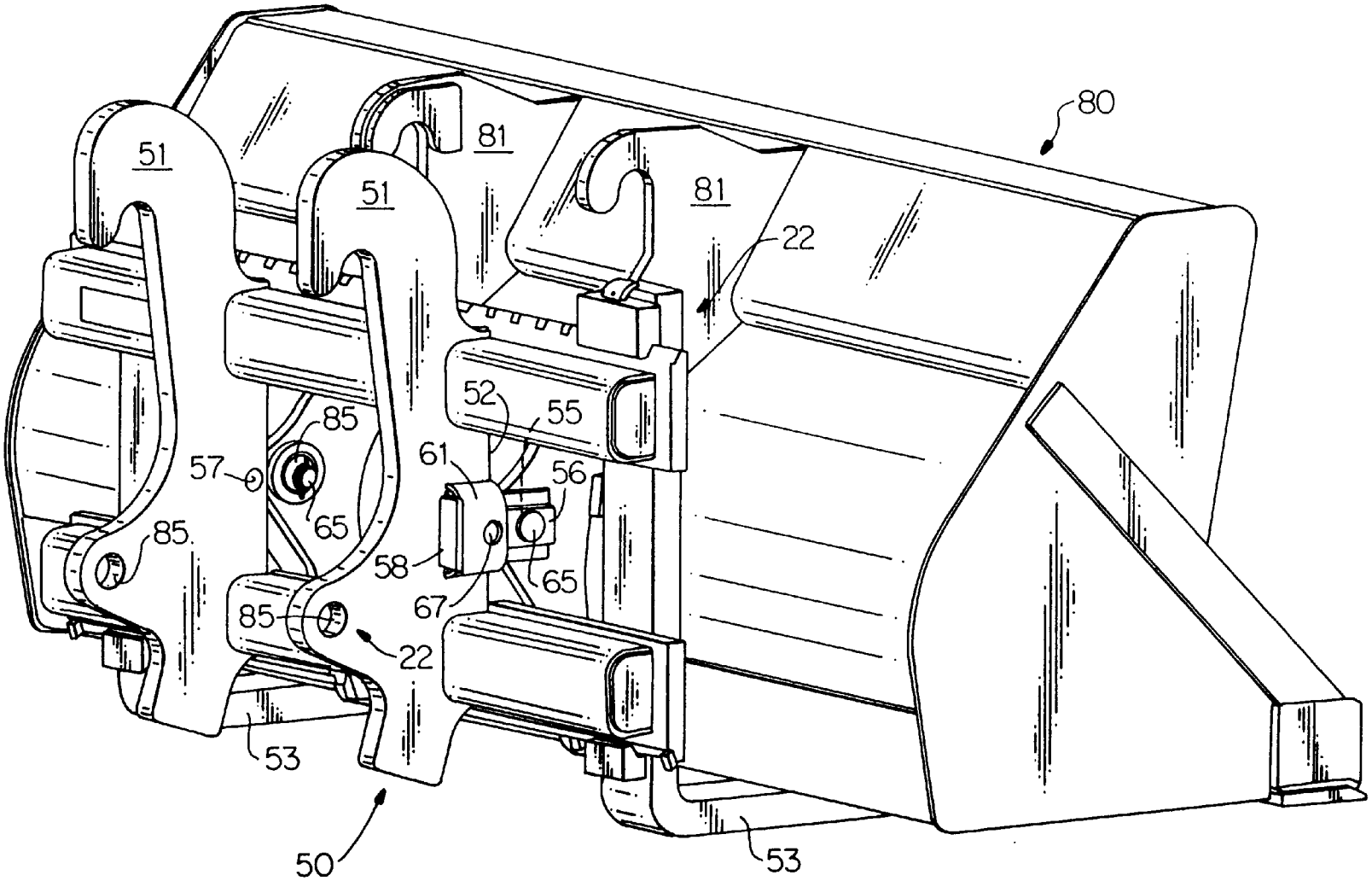
FIG. 4 is a rear perspective view of a pallet fork attachment for a work machine embodying a first embodiment of a retainer coupling with a loading bucket positioned thereon and connected to the pallet fork attachment for transportation purposes.
Figure 5:
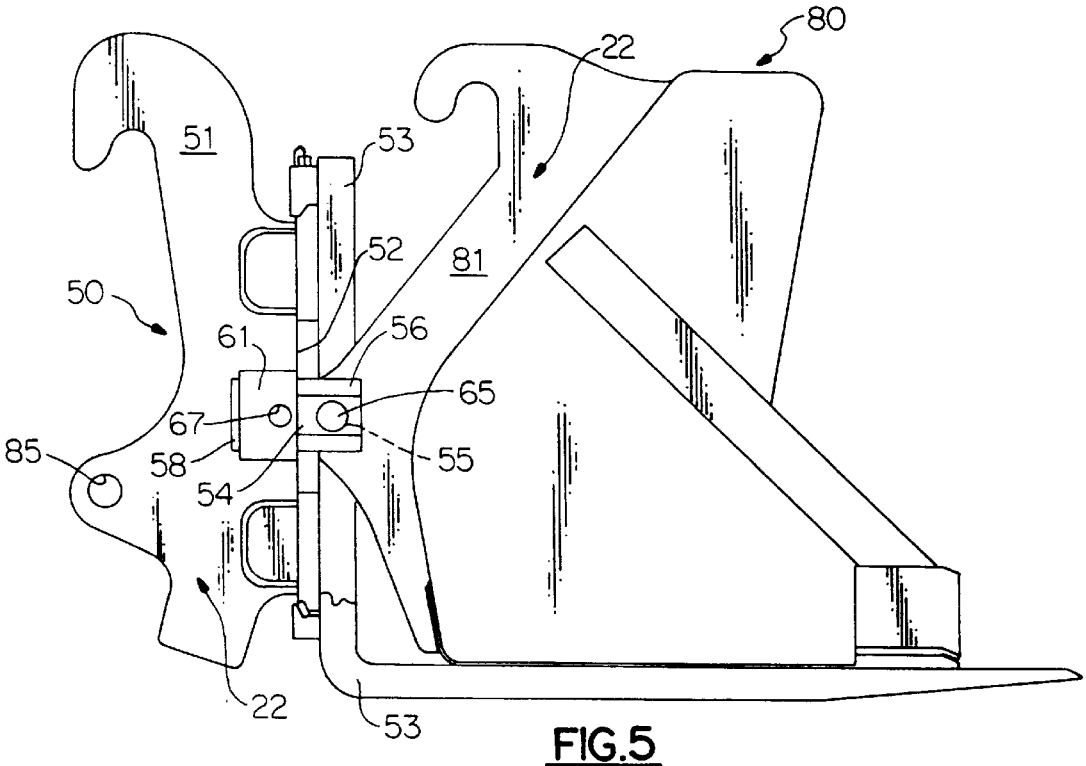
FIG. 5 is a side elevational view of the pallet fork attachment illustrated in FIG. 4 with portions broken away to better show the elements of the retainer coupling.

The first embodiment of the retainer or secondary coupling, best illustrated in FIGS. 3–5, includes a "C" or "U" shaped bracket 61 welded to each one of a pair of vertically extending forks carriage plates 51, and positioned adjacent to an outside leading edge 52 thereof. Because the structure and function of each of the elements of the retainer coupling is the same on both of the vertically extending forks carriage plates 51, for convenience of illustration the structure and function of the invention will be described in detail with reference to only one of the plates 51.

An "L"-shaped securing plate 54, having a securing aperture 55 formed in a distal end 56 thereof, is slidably carried within each of the brackets 61 for movement toward and away from the outside leading edge 52 of the vertically extending forks carriage plates 51. The "L"-shaped securing plate 54 is slidable from a first or retracted position wherein the distal end 56 thereof is adjacent to the outside leading edge 52 of the forks carriage plates 51, illustrated in FIG. 3, to a second or extended position, illustrated in FIGS. 4 and 5, wherein the distal end 56 thereof extends outwardly beyond the outside leading edge 52 of the forks carriage plates 51 a distance sufficient so that the apertures 55 formed therein may be concentrically aligned with a connecting pin hole 85 formed in each loading bucket carriage plates 81 of the loading bucket 80 when the loading bucket is positioned onto fork tines 53 of the pallet forks attachment 50. When the loading bucket connecting pin holes 85 are coaxially aligned with the aperture 55 formed in the securing plate 54, locking pins 65 are inserted through the concentrically aligned holes, thereby rigidly securing the loading bucket 80 to the pallet forks attachment 50 for transportation by the work machine. An aperture 67 is formed in the bracket 61 for retaining the securing plate 54 in the retracted position. To this end the lock pin 65 is passed through the apertures 67 and 55 into securing aperture 54 formed in the forks carriage plates 51 when the securing plate 54 is retracted. A proximal end 58 of the securing plate 54 forms the short leg of the "L" shape and functions as a stop to limit the forward positioning of the securing plate 54.

Figure 8:
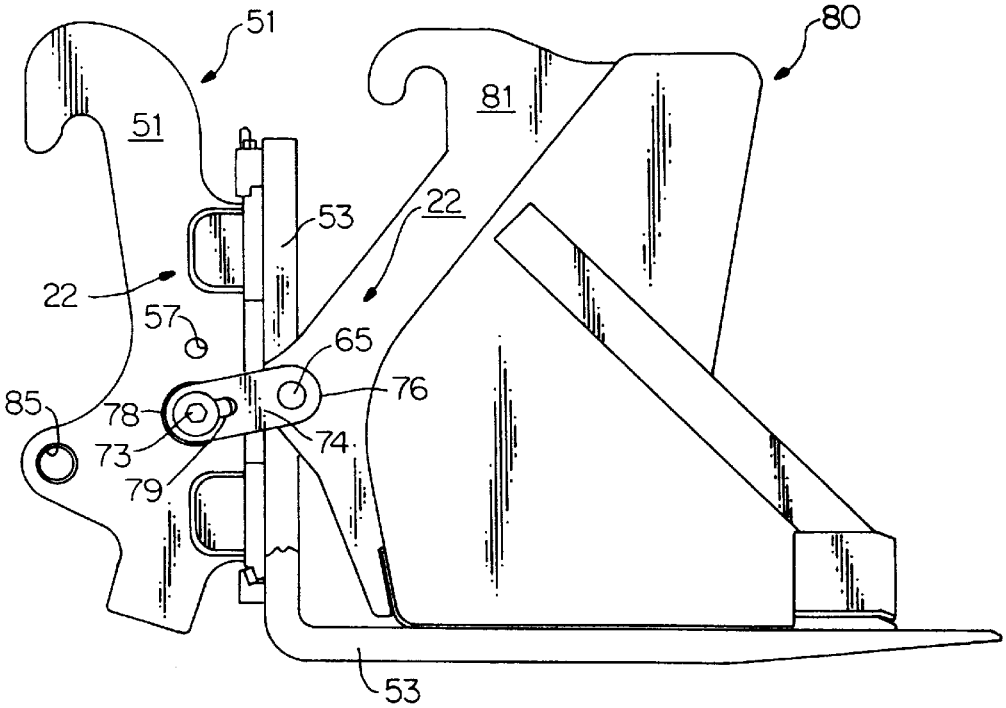
FIG. 8 is a side elevational view of the pallet fork attachment illustrated in FIG. 7 with portions broken away to better show the elements of the invention.
Figure 6:
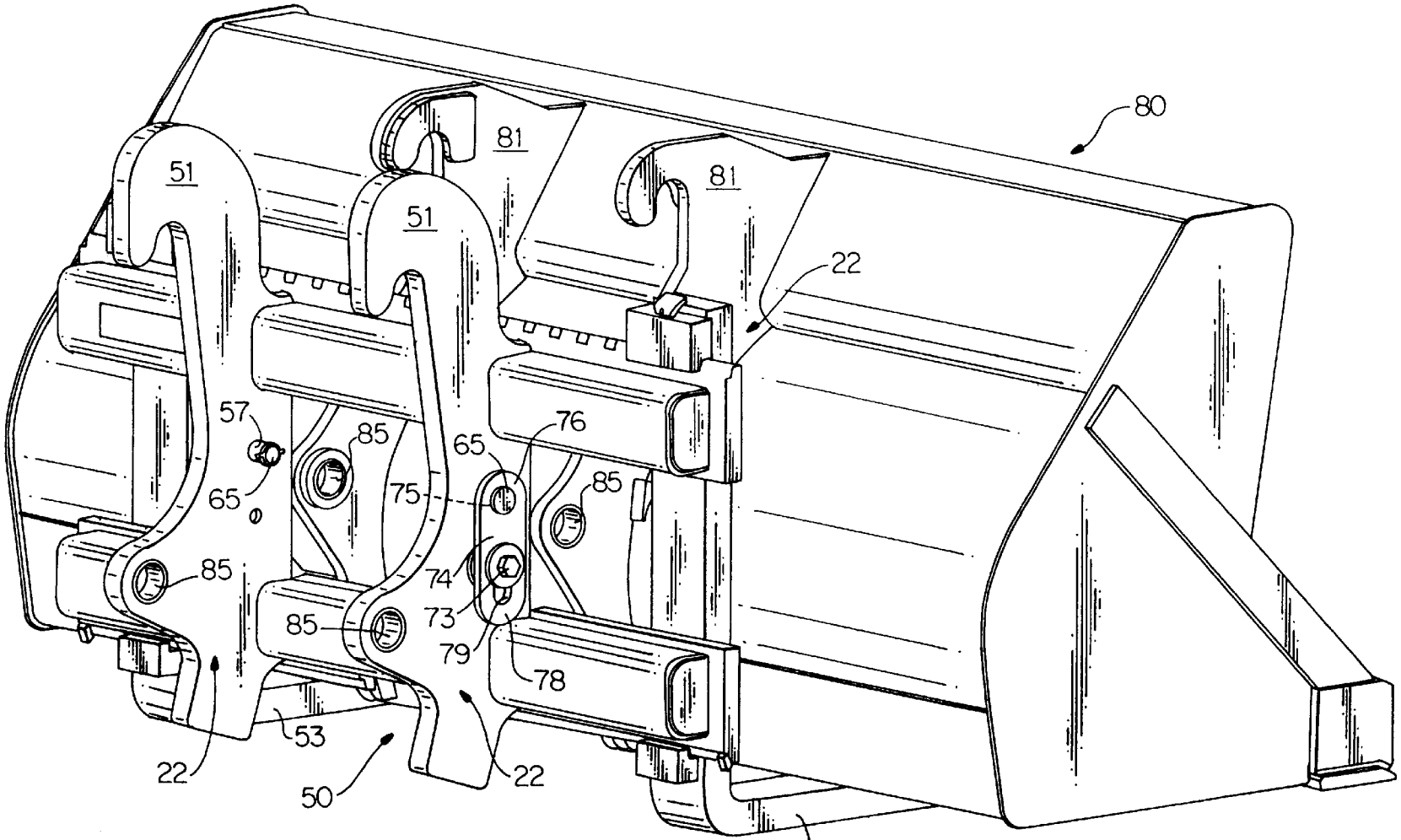
FIG. 6 is a rear perspective view of a pallet fork attachment for a work machine embodying a second embodiment of the retainer coupling with a loading bucket positioned thereon to be connected to the pallet fork attachment for transportation purposes.
Figure 7:
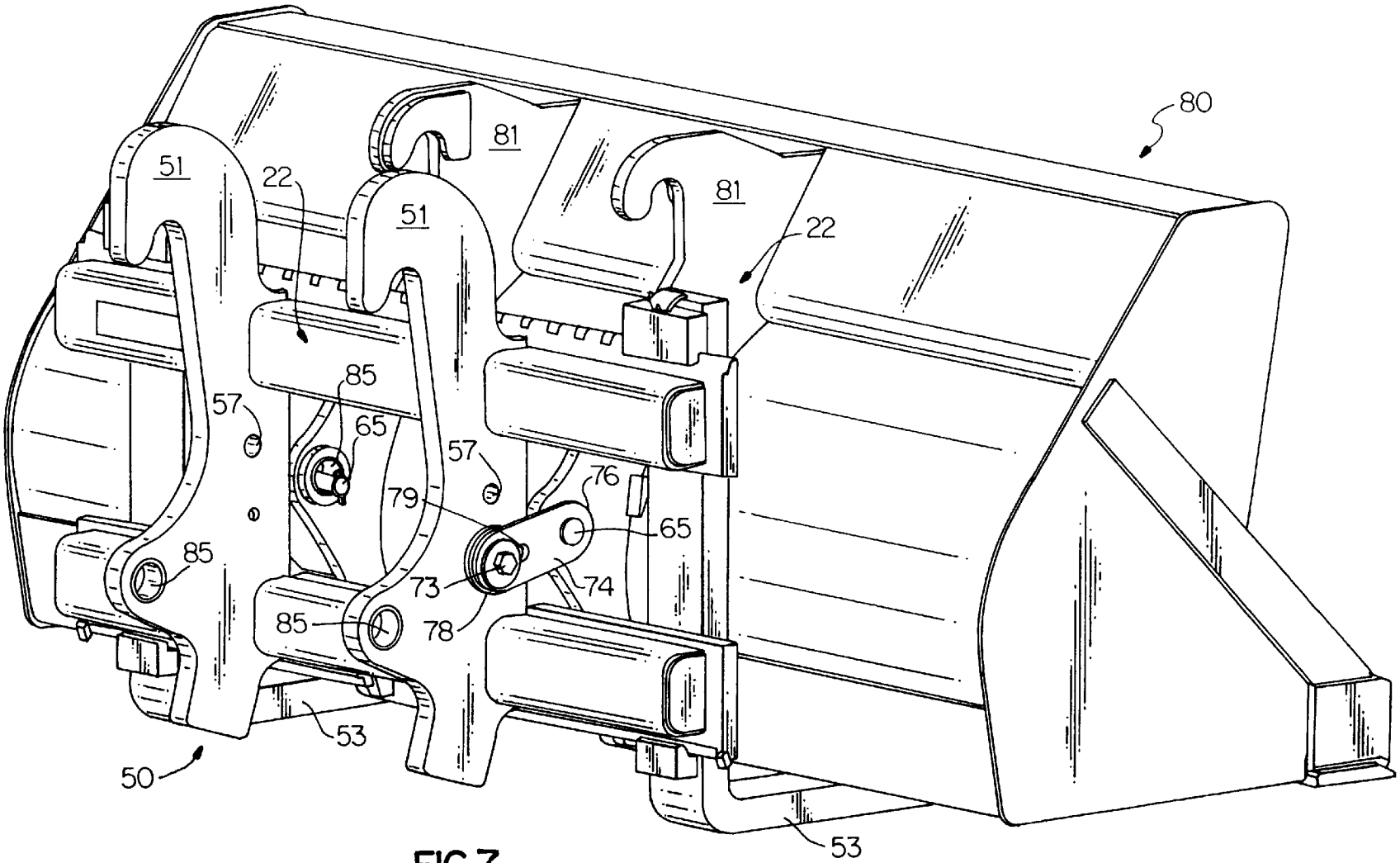
FIG. 7 is a rear perspective view of a pallet fork attachment for a work machine embodying a second embodiment of the retainer coupling with a loading bucket positioned thereon and connected to the pallet fork attachment for transportation purposes.

In the second embodiment of the retainer or secondary coupling, a pivotal link 74 is secured to the outside of each one of the forks carriage plates 51, and may be pivoted about a pivot connection 73 from a first or storage position in which the links 74 are secured to the aperture 57 of the forks carriage plates 51, as illustrated in FIG. 6, to a second or extended position wherein the links 74 may be secured to the connecting pin holes 85 of the loading bucket 80, as illustrated in FIGS. 7 and 8. To this end, the distal end 76 of each link 74 is formed with an aperture 75, for selectively coupling the links 74 to the forks carriage plates 51 or the connecting pin holes 85 of the loading bucket 80.

When it is desired to secure the links 74 in the storage position, the links 74 are pivoted into a position wherein the aperture 75 can be coaxially aligned with the link securing aperture 57 formed in each of the forks carriage plates 51, and the locking pins 65 inserted therethrough to lock the links 74 into the storage position. When it is desired to connect the links 74 to the loading bucket 80 for transporting the loading bucket on the work vehicle, the links 74 are pivoted into a position wherein the apertures 75 can be coaxially aligned with the connecting pin holes 85 of the loading bucket 80, and the locking pins 65 are then inserted therethrough to lock the links 74 to the loading bucket. To enable the links 74 to be moved toward or away from the link securing apertures 57 and the loading bucket connecting pin holes 85 to accommodate special differences in the location of different buckets, the pivot connection 73 at the proximal end 78 of each link 74, is formed with a slot 79 to enable the link 74 to be moved relative to the pivotal connection 73 for concentrically aligning the apertures 75 with the loading bucket connecting pin holes 85, as desired. In this manner, the apertures 75 in the distal end of the pivotal links 74 can be concentrically aligned with the link securing apertures 57 for storage, and the connecting pin holes 85 of the loading bucket to rigidly connect the two work implements together when it is desired to transport both work implements.

INDUSTRIAL APPLICABILITY

When operating a work vehicle such as a backhoe or wheel loader 100, it is frequently desirable to utilize auxiliary equipment with the vehicle, such as a pallet fork 50 and a loading bucket 80. Accordingly, the work vehicle 100 is equipped with a primary coupling system 20, best illustrated in FIGS. 1 and 2, whereby various work implements, such as the pallet forks attachment 50 and the loading bucket 80, all of which have vertically extending carriage plates 51 or 81 and connecting pin holes 85 to form a portion of the primary coupling system 20 for connecting the work implements to the work vehicle. In the course of operation, it is generally necessary to move the vehicle 100 from one site to another, which requires movement of the auxiliary work implements as well as the vehicle. This invention provides a convenient secondary or carrier retainer system for securely attaching a second work implement, such as a loading bucket 80, to a first work implement, such as a pallet forks attachment 50, for transportation purposes so that the connected auxiliary work equipment can be readily transported by the work vehicle 100 from one site to another site. This is especially beneficial when the work vehicle must move over rough surfaces or uneven terrain.

The quick and convenient coupling of the pivot link 74, or the "L"-shaped slider 54, mounted on the forks carriage plates 51 of the pallet forks attachment 50, to loader bucket 80 permits both work implements to be easily transported together between work sites, yet separately operated on site. In this manner both the load lifting capacity and payload of the work vehicle 100, as well as its efficiency, are increased.

While this invention has been described in the specification and illustrated in the drawings with reference to a preferred embodiment, the structure of which has been disclosed herein, it will be understood by those skilled in the art to which this invention pertains that various changes or modifications may be made and equivalents may be substituted for elements of the invention without departing from the scope of the claims. Therefore, it is intended that the invention not be limited to the particular embodiment disclosed in the specification and shown in the drawings as the best mode presently known by the inventors for carrying out this invention, nor confined to the details set forth in the preferred embodiments, but that the invention will include all embodiments, modifications and changes as may come within the scope of the following claims:

What is claimed is:

1. In a pallet fork attachment for use with a work vehicle and having a plurality of fork tines or receiving and carrying a load thereupon, and a plurality of forks carriage plates for coupling the pallet fork attachment to the work vehicle, the improvement comprising:

a retainer coupling carried by at least one of said plurality of forks carriage plates for releasably engaging a connecting aperture of a work implement carried upon said plurality of fork tines;

said retainer coupling including a slider bracket secured to at least one of said plurality of forks carriage plates and forming a securing plate receiving opening therewith for slidably receiving a securing plate to connect said work implement carried upon said plurality of fork tines to said one of said plurality of fork carriage plates;

a slidable securing plate having a distal end including a locking pin receiving aperture formed therein and a proximal end including a stop portion to limit the movement of said securing plate relative to said slider bracket positioned in said slider bracket for sliding movement relative thereto;

said slidable securing plate extending a length such that said locking pin receiving aperture formed in the distal end thereof is positionable in coaxial alignment with said connecting aperture of the work implement carried upon said plurality of fork tines when said securing plate stop portion is moved toward engagement with said slider bracket; and a locking pin insertable through said coaxially aligned locking pin aperture formed in said securing plate of said retainer coupling and said connecting aperture formed in said work implement to rigidly connect the work implement carried upon said plurality of fork tines to said pallet fork attachment.

2. The pallet fork attachment of claim 1 wherein said slider bracket is formed with an aperture therein for receiving said locking pin.

3. The pallet fork attachment of claim 2 wherein said at least one of said forks carriage plates is formed with an aperture therein in coaxial alignment with said aperture formed in said slider bracket for receiving said locking pin to retain said slidable securing plate in a fixed position on said forks carriage plate.

4. The pallet fork attachment of claim 1 including a plurality of said retainer couplings wherein one of said retainer couplings is carried on each of said plurality of forks carriage plates.

5. The pallet fork attachment of claim 1 wherein said slider bracket is formed as a substantially "U"-shaped bracket, and said slidable securing plate is formed as a substantially "L"-shaped plate and the short leg of the "L" comprises said stop portion thereof.

6. The pallet fork attachment of claim 5 wherein said locking pin receiving aperture formed in the distal end of said slidable securing plate is positionable in coaxial alignment with said connecting aperture of the work implement carried upon said plurality of fork tines when said short leg portion of said substantially "L"-shaped plate engages said "U"-shaped bracket.

7. In a pallet fork attachment for use with a work vehicle and having a plurality of fork tines for receiving and carrying a load thereupon, and a plurality of forks carriage plates for coupling the pallet fork attachment to the work vehicle, the improvement comprising:

a retainer coupling carried by at least one of said plurality of forks carriage plates for releasably engaging a connecting aperture of a work implement carried upon said plurality of fork tines;

said retainer coupling including a pivotal securing link secured to at least one of said plurality of forks carriage plates and forming a securing link for connecting said work implement carried upon said plurality of fork tines to said one of said plurality of forks carriage plates;

said pivotal securing link having a distal end including a locking pin receiving aperture formed therein, and a proximal end pivotally connected to said at least one of said forks carriage plates;

said pivotal securing link extending a length such that said locking pin receiving aperture formed in the distal end thereof is positionable in coaxial alignment with said connecting aperture of the work implement carried upon said plurality of fork tines; and a locking pin insertable through said coaxially aligned locking pin aperture formed in said pivotal securing link of said retainer coupling and said connecting aperture formed in said work implement to rigidly connect the work implement carried upon said plurality of fork tines to said pallet fork attachment.

8. The pallet fork attachment of claim 7 wherein said distal end of said pivotal securing link is formed with a slot at said pivotal connection with said at least one of said forks carriage plates to enable said pivotal securing link to be moved toward and away from said pivotal connection.

9. The pallet fork attachment of claim 7 wherein said at least one of said forks carriage plates is formed with an aperture therein coaxial alignable with said aperture formed in said distal end of said pivotal securing link for receiving said locking pin to retain said pivotal securing link in a fixed position on said forks carriage plate.

10. The pallet fork attachment of claim 7 including a plurality of said retainer couplings wherein one of said retainer couplings is carried on each of said plurality of forks carriage plates.

* * * * *